US005870116A

United States Patent [19]

Kyoshima

[11] Patent Number: 5,870,116

[45] **Date of Patent: *Feb. 9, 1999**

[54] SPIRAL STAGGERED CLEANING MEMBER FOR A FULL-WIDTH ARRAY INK JET APPARATUS

[75] Inventor: Masayuki Kyoshima, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 420,315

[22] Filed: Apr. 10, 1995

[30] Foreign Application Priority Data

Apr. 13, 1994 [JP] Japan ..... 6-099313

[51] Int. Cl.[6] ..... B41J 2/165; A46B 15/00; B41F 35/00

[52] U.S. Cl. ..... 347/33; 15/256.5; 400/701

[58] Field of Search ..... 347/33, 28, 42, 347/31; 15/256.5; 400/701

[56] References Cited

U.S. PATENT DOCUMENTS 4,947,194 8/1990 Kyoshima ..... 347/42
5,051,758 9/1991 Markham ..... 347/33
5,374,981 12/1994 Yamamoto et al. ..... 355/259
5,398,054 3/1995 Fukazawa et al. ..... 347/33

FOREIGN PATENT DOCUMENTS 6-234222 2/1993 Japan ..... B41J 3/04

*Primary Examiner*—Benjamin R. Fuller
*Assistant Examiner*—Thien Tran
*Attorney, Agent, or Firm*—Fitzpatrick, Cella, Harper & Scinto

[57] ABSTRACT

A wiping member is described for slidingly cleaning a discharge port face of an ink jet recording apparatus, wherein electrothermal convertors generate heat energy causing film boiling in the ink so that the ink is discharged from the discharge ports. By reducing the simultaneous contact area of the wiping member which can slide on the discharge port face, as well as moving successively the contact area, the deformation or distortion of the wiping member, is deminished. The entire area thus can be wiped uniformly even if the array of discharge ports is longer. The wiping member comprises a cylindrical support rotated in a direction perpendicular to the array of discharge ports, and wiper portions made of a rubber elastic material arranged in a spiral or stagger form which are secured on the peripheral face of the cylindrical support, with a wiper cleaner which is an ink absorber to make contact with the wiper portions being disposed near the wiping member.

8 Claims, 4 Drawing Sheets

SPIRAL STAGGERED CLEANING MEMBER FOR A FULL-WIDTH ARRAY INK JET APPARATUS

BACKGROUND OF THE INVENTION

1. Field of the Invention

The present invention relates to a cleaning device for cleaning the discharge port face of an ink jet head which performs the recording by discharging the ink from recording means onto the recording medium, and an ink jet apparatus with the cleaning device mounted, and more particularly to a cleaning device with improved cleaning performance and an ink jet apparatus with the cleaning device mounted.

2. Related Background Art

Recording apparatuses having the features of printer, copying machine and facsimile, or recording apparatuses for use as the output device for a composite equipment or a work station containing a computer, a word processor and so on are configured to record the image (including characters or symbols) onto the recording sheet (recording medium) such as a paper or a plastic thin plate (e.g., OHP), based on image information. Such recording apparatuses can be classified into an ink jet system, a wire dot system, a thermal system, a thermal transfer system and a laser beam system, depending on the recording method for recording means used.

In a serial type recording apparatus which takes the recording system of scanning in a direction crosswise to the conveying direction of recording sheet (sub-scan direction), the image can be recorded on a desired range of the recording sheet in such a way as to, after setting the recording sheet at a predetermined recording position, repetitively perform the operation of recording the image (including characters or symbols) by recording means (recording head) mounted on a carriage moving (scanning) along the recording sheet, including recording one line, then feeding (sub-scanning) the sheet by a predetermined amount, and recording (scanning) the image at the next line. On the other hand, in a line type recording apparatus which performs the recording only by the sub-scanning of feeding the recording sheet in a conveying direction, the image is recorded over the recording sheet in such a manner as to set the recording sheet at a predetermined recording position, and then consecutively perform the operation including recording one line at a time, and feeding the sheet by a predetermined amount (pitch feeding).

Among them, an ink jet system (ink jet recording apparatus) which performs the recording by discharging the ink from recording means (recording head) onto the recording sheet has the advantages in which recording means can be made compact, the higher definition image can be recorded at a higher speed, the ordinary paper is usable for recording without needs of any special treatment, the running cost is low, there is less noise owing to the non-impact method, and the color image is easily recorded by using color inks. In particular, a line-type recording apparatus using recording means of the line type in which a number of discharge ports are arranged in a direction of the sheet width allows the recording to be made at higher speed.

Specifically, recording means (recording head) of the ink jet system of discharging the ink by the use of heat energy can be easily fabricated with an arrangement of liquid paths (discharge ports) at high density by forming electrothermal converters, electrodes, liquid path walls, and a ceiling plate as the film on a substrate through the semiconductor fabrication process including etching, vapor deposition and sputtering, and thus can be made more compact. Also, by utilizing the merits of the IC technology or micro-process technology, recording means can be easily lengthened, and readily made a full-multi configuration or higher density packaging.

In an ink jet recording apparatus which performs the recording by discharging the ink through fine discharge ports onto the recording sheet, the condition of the discharge port face of the recording head on which a plurality of discharge ports are arranged in a predefined array may have significant effects on the recording quality. That is, if the discharge port face is wet with the ink or water droplets, or has adherent foreign matter, ink droplets discharged may be deflected in the discharge direction, drawn by the wetting or foreign matter, or the normal discharge is prevented, resulting in a discharge failure (including undischarged). To remove such ink or foreign matter adhering to the discharge port face, it is common practice to wipe and clean the discharge port face with a wiper formed of a plate-like rubber elastic member at predetermined timings.

By the way, in the conventional ink jet recording apparatus, a blade made of rubber elastic material in a flat plate form disposed in parallel to the discharge port array is placed into contact with the discharge port face, and either the recording head or the blade is moved in parallel in a direction perpendicular to the discharge port array to cause the blade to slide on the discharge port face in a direction transverse to the discharge port array, thereby enabling the wiping operation. Therefore, at the wiping, the entire area of the discharge port array is brought into contact with the blade at the same timing, and cleaned off.

However, in such conventional ink jet recording apparatus, since the end face of blade is simultaneously brought into contact with the entire area of the discharge port array, it is considered that if there are more discharge ports and the blade (wiping member) is longer, as with the line recording head, for example, the blade is prone to deformation or distortion which makes it difficult to cause the blade to slide on all the discharge ports uniformly (evenly), thereby degrading the wiping function of the blade (wiping member).

Namely, unless the parallelism between the discharge port face of recording head and the contact face of blade is secured with high precision, the blade may not be placed evenly into contact with all the discharge ports of the lengthy head, resulting in unevenness of cleaning, or if the cleaning is repetitively executed over the long term, it may possibly have some effects on the condition of the discharge port face.

SUMMARY OF THE INVENTION

The present invention has been achieved in the light of the above-mentioned technical problems, and an object of the present invention is to provide a cleaning device and an ink jet recording apparatus with the cleaning device, wherein the cleaning device is capable of wiping the entire area of the array of discharge ports uniformly, even if the array of discharge ports is long, by reducing in size the contact face of a wiping member which can make contact with the discharge port face at the same time to diminish the deformation or distortion of the contact portion of the wiping member, as well as moving successively the contact face of the wiping member with the discharge port face.

The present invention has been proposed to accomplish the above object, and is characterized in that a wiping member for slidingly cleaning the discharge port face of recording means is provided in an ink jet recording apparatus which performs the recording by discharging the ink from recording means onto the recording sheet, the wiping member having a cylindrical support revolvable in a direction perpendicular to the discharge port array and an elastic member disposed on the cylindrical support of which the contact area with the discharge port face moves along with the revolution of the cylindrical support.

Further, it is an object of the invention to provide an ink jet recording apparatus which performs the recording by discharging the ink from recording means onto the recording sheet, comprising a wiping member for slidingly cleaning the discharge port face of recording means, characterized in that the wiping member is a member revolvable in a direction perpendicular to the discharge port array and of which the contact area with the discharge port face moves along with the revolution.

DETAILED DESCRIPTION OF THE PREFERRED EMBODIMENTS

Figure 1:
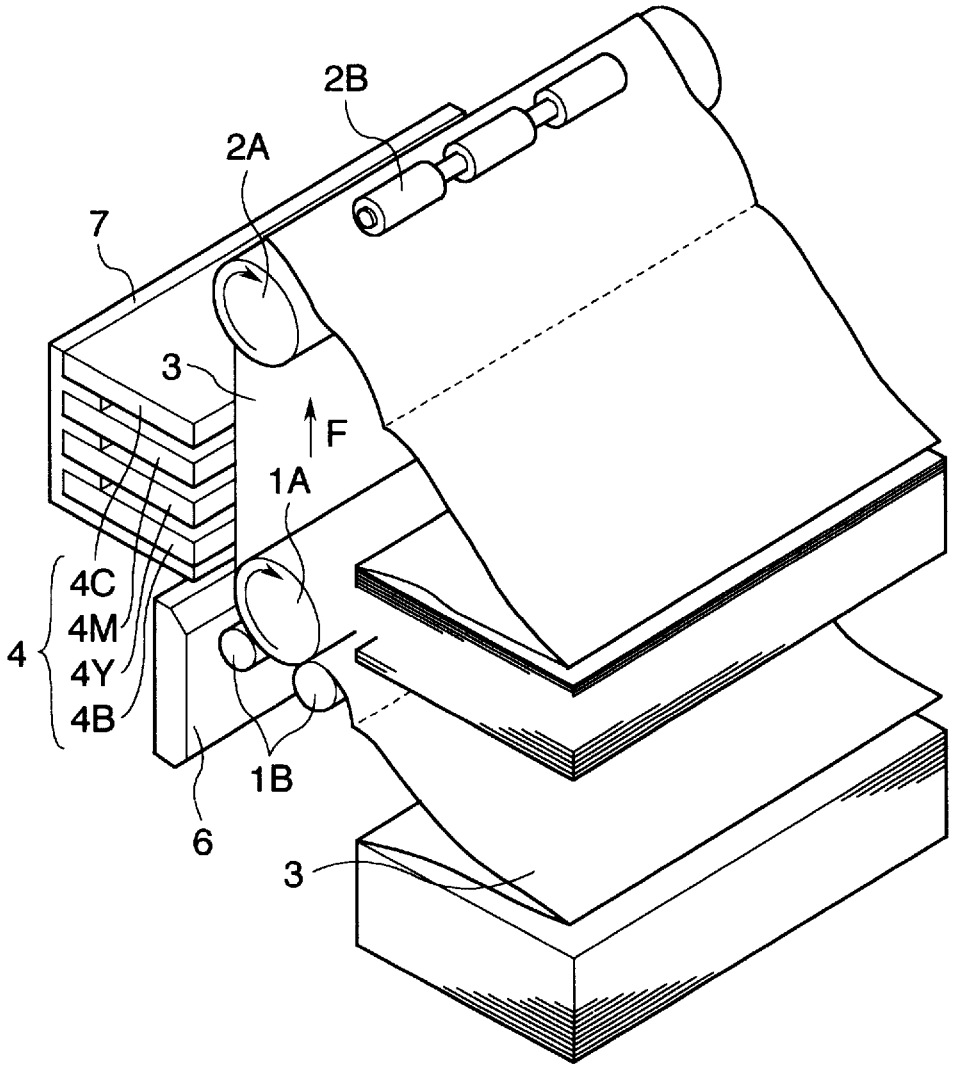
FIG. 1 is a typical perspective view illustrating the construction of an example of an ink jet recording apparatus suitable for applying the present invention thereto.

The embodiments of the present invention will be now described below with reference to the drawings. Note that like symbols refer to like or corresponding parts throughout the figures. FIG. 1 is a typical perspective view showing an example of an ink jet recording apparatus suitable for applying the invention thereto. The ink jet recording apparatus of FIG. 1 is a full color recording apparatus having a plurality of (four in this figure) line type recording heads for recording in different colors.

In FIG. 1, numerals 1 and 2 represent a pair of rollers carrying the recording sheet 3 such as a paper or plastic thin plate therebetween and conveying (feeding) the recording sheet 3 in a sub-scan direction (conveying direction) indicated by the arrow F. In this example as shown, a pair of rollers 1 on the supply side consists of a conveying roller 1A driven for rotation and two feed rollers 1B, 1B which are forced against the peripheral surface of the conveying roller, and a pair of rollers 2 on the exhaust side consists of a paper exhausting roller 2A driven for rotation in synchronism with the conveying roller 1A and a bail roller which is forced against the peripheral surface of the paper exhausting roller.

4B, 4Y, 4M and 4C are line recording heads of the full-multi type with the discharge ports arranged over the substantial entire width of the recording sheet 3. Note that any one or the whole of these recording heads can be indicated simply by recording head (recording means) 4. In the case of the full-color recording, the colors of the inks which are discharged from the above-mentioned four recording heads 4 may be, for example, black (B), yellow (Y), magenta (M) and cyan (C), wherein the four recording heads 4 are arranged in this order from upstream in the conveying direction in the recording sheet (from the bottom side as seen in the figure) in this example as shown.

In FIG. 1, 6 is a recovery system for preventing the ink discharge failure of each recording head 4. This recovery system 6 can move between each recording head 4 and the recording sheet 3, when not printing, to confront the discharge port face of each recording head 4, in place of the recording sheet 3, thereby effecting a discharge recovery process involving capping, predischarge, suction recovery, or wiping. Each recording head 4 is mounted on a head mount portion 7 with the mutual positional relation regulated. In the above way, the ink jet recording apparatus is constructed having the head mount portion 7 for mounting the recording head 4, a line type recording head 4 mounted on the head mount portion 7, and conveying means 1, 2 for conveying the recording sheet 3 to the recording position facing the recording head 4.

Recording means (recording head) 4 is an ink jet recording means for discharging the ink by the use of heat energy, comprising electrothermal converters for generating the heat energy. Also, this ink jet recording means 4 discharges the ink from the discharge ports for the recording in the manner to utilize the pressure changes generated by the growth or shrinkage of bubbles produced by film boiling caused by the heat energy applied by the electrothermal converters.

Figure 2:
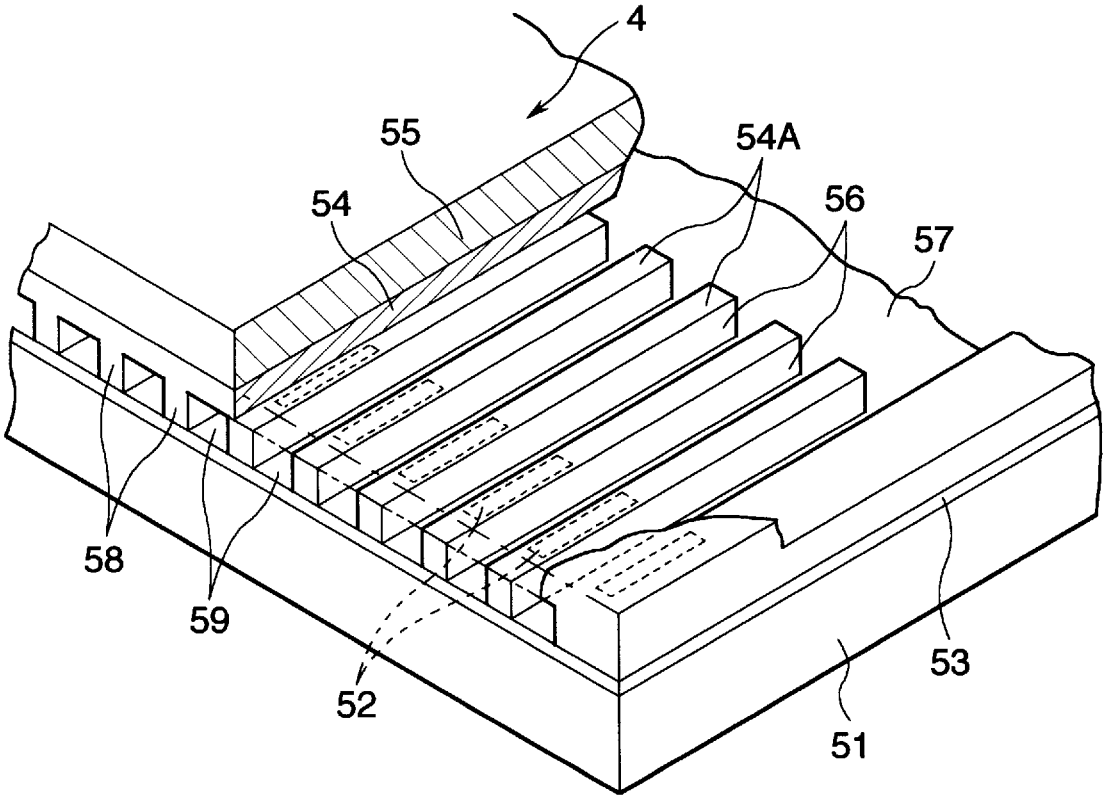
FIG. 2 is a partial perspective view schematically showing the structure of an ink discharge section of recording means as shown in FIG. 1.

FIG. 2 is a partial perspective view showing schematically the structure of an ink discharge section of the recording head 4. In FIG. 2, on a substrate (base plate) 51 of the recording head 4 are formed, with the interposition of a layer of a thin film 53, a plurality of electrothermal converters 52 and corresponding wirings, through a manufacturing process (e.g., a thin film molding method) similar to that of the semiconductor. Each electrothermal converter 52 is disposed at a position corresponding to a respective discharge port 59 and a liquid path 56, as shown in this figure. On the substrate (base plate) 51 (or the thin film 53 on the substrate 51) is bonded a liquid path forming member 54 having a plurality of liquid path walls 54A formed in parallel to the bottom face at a predetermined interval. Further, on the upper surface of the liquid path forming member 54 is bonded a ceiling plate 55.

Each liquid path 56 is formed between liquid path walls 54A, wherein the liquid path forming member 54 is positioned and bonded in such a positional relation that each electrothermal converter 52 is disposed at a predetermined position within each liquid path 56. Each liquid path wall 54A has a predetermined length, the rear end of each liquid path 56 communicating to a common liquid chamber 57 formed between the liquid path forming member 54 and the substrate (base plate) 51 (or thin film 53). On the other hand, the other end (top end) of each liquid path 56 opens toward the discharge port face 58 (the front face having a plurality of discharge ports 59 arranged) of the recording head 4, each discharge port 59 being formed by a respective opening portion.

In this way, an ink jet recording head 4 is constructed which involves discharging ink droplets through the discharge ports 59 in the manner to conduct electricity (apply a pulse voltage) to the electrothermal converters 52 such as heat generating resistors for the heating, causing film boiling in the ink within the liquid paths 56, and making use of pressure changes occurring at that time. This recording head 4 is mounted in an orientation with the direction of the array of discharge ports 59 being crosswise (substantially orthogonal) to the conveying direction of the recording sheet 3 (e.g., a recording paper), the distance (paper-to-paper distance) between the discharge port face 58 and the recording sheet 3 being set to, for example, approximately 0.5 to 2.0 millimeters.

Figure 3:
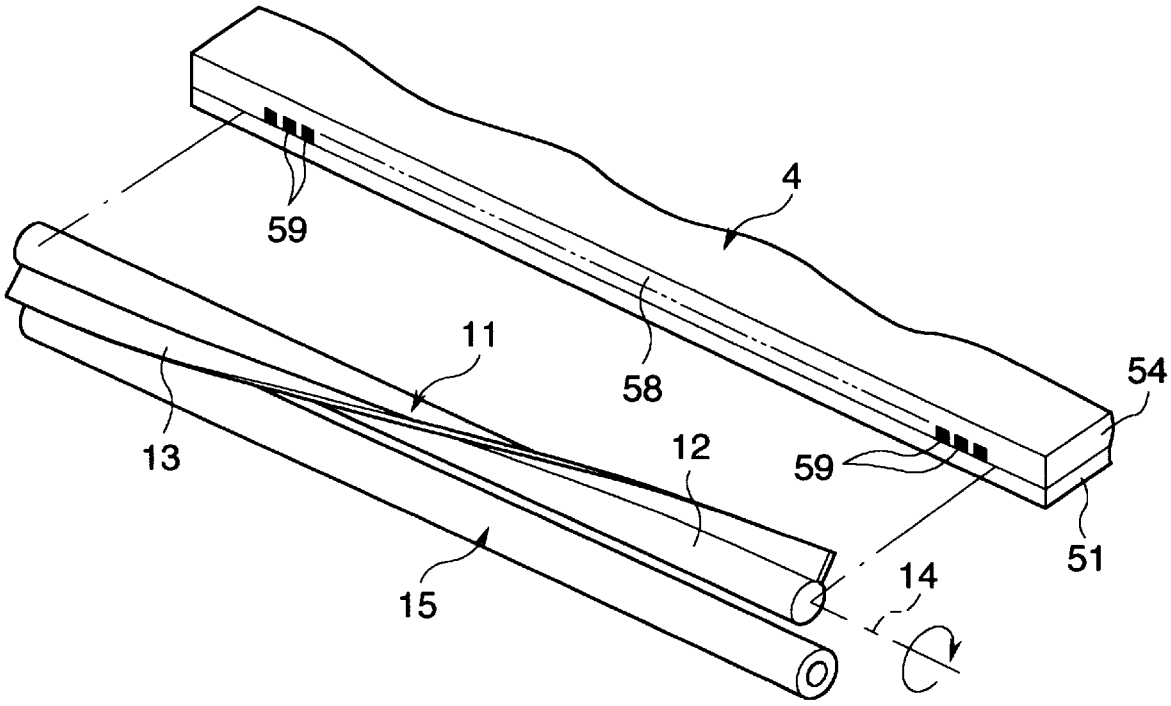
FIG. 3 is a typical perspective view showing a first example of a wiping member according to the present invention.

FIG. 3 is a typical perspective view showing the essence of a first example of an ink jet recording apparatus to which the present invention is applied, that is, a first example of a wiping member according to the present invention. In FIG. 3, in front of the recording head 4 is disposed a wiping member 11 for slidingly cleaning (wiping) the discharge port face 58, this wiping member 11 being configured to have an area, as its part, which can make contact with the discharge port face 58 at the same time, while the range on the discharge port face 58 contacted by the wiping member at the same time is part of the discharge port face 58.

The wiping member 11 has a structure in which a spiral wiper portion 13 is secured onto the peripheral surface of the cylindrical support 12. On the discharge port face 58 of the recording head 4 are arranged a plurality of discharge ports 59 over the substantial entire width of the recording sheet 3 in a direction orthogonal (perpendicular) to the recording sheet conveying direction (sub-scan direction) to form an array of discharge ports. And the cylindrical support 12 has a length extending over the entire length of the array of discharge ports on the discharge port face 58, and is supported rotatably around a shaft 14 parallel to the array of discharge ports (in a direction perpendicular to the array of discharge ports).

The wiper portion 13 is formed of a rubber-like elastic material having a predetermined thickness, and fixedly disposed in spiral form around the peripheral surface of the cylindrical support 12, as shown. A top end face of the wiper portion 13 has the same radial height as a whole. And the wiper member 11 has the wiper portion part of which can be brought into contact with part of the array of discharge ports on the discharge port face 58 at a predetermined pressure, and is attached to be driven for rotation around the shaft 14 of the cylindrical support 12. That is, the wiping member 11 is rotated in a direction perpendicular to the array or discharge ports (row of discharge ports 59), its contact area with the discharge port face 58 (or the area which can be brought into contact therewith at the same time) being moved successively with the rotation.

Near the cylindrical support 12 is disposed a cylindrical wiper cleaner 15 for sucking (absorbing) the foreign matter (e.g., the ink wiped from the discharge port face 58) adhering to the wiper portion 13 by making contact with the wiper portion 13 of the wiping member when the wiping member 11 is further rotated. This wiper cleaner 15 is formed of a cylindrical member made of ink absorbent material such as a porous elastic resin or a sponge, and normally supported rotatably around its shaft. Herein, it is desirable that the rotational shaft 14 is placed parallel to the discharge port face 58 of the recording head at high accuracy. Also, if the height of the wiper portion 13 is even over the entire width, the cleaning can be more effectively made.

With the constitution of FIG. 3, if an instruction for wiping operation is issued, the cylindrical support 12 is moved toward the discharge port face 58 to bring part (a first end) of the wiper portion 13 into contact with part (a first end) of the array of discharge ports. Then, if the cylindrical support 12 is rotated around the rotational shaft 14 of the cylinder, the wiper 13 slidingly cleans the discharge port face 58 in a rotation direction. Along with the rotation, the contact face (contact portion) between the wiper portion 13 and the discharge port face 58 is moved successively toward the other end of the wiper portion and the array of discharge ports, until ultimately it slidingly cleans the entire area of the array of discharge ports.

With a further rotation of the wiping member 11, the wiper portion 13 is brought into contact with the wiper cleaner 15 and cleaned. In this way, upon one rotation of the wiping member 11, a entire area of the discharge port face 58 around the array of discharge ports and the entire area of the wiper portion 13 can be cleaned.

With this example as above described, the following effects can be obtained. Firstly with the reduced contact face (the range which can be brought into contact at the same time) between the wiper portion 13 and the discharge port face 58, the wiper portion 13 at the contact portion upon contacting is less liable to deformation or distortion, so that the contact condition can be held uniform, and the wiping (cleaning) of the discharge port face 58 with high reliability can be accomplished.

Secondly, simply by rotating the cylindrical support 12, the contact face between the wiper portion 13 and the discharge port face 58 can be moved in a direction to the array of discharge ports, so that even with a great number of discharge ports 59 and the greater length of the array of discharge ports, as may occur with the line-type recording head, the entire area of the array of discharge ports can be cleaned securely and uniformly with a simple operation. Thirdly, with the cylindrical wiper cleaner 15 placed adjacent the wiping member 11, the wiper portion 13 can be also cleaned easily with the same rotational operation.

Figure 4:
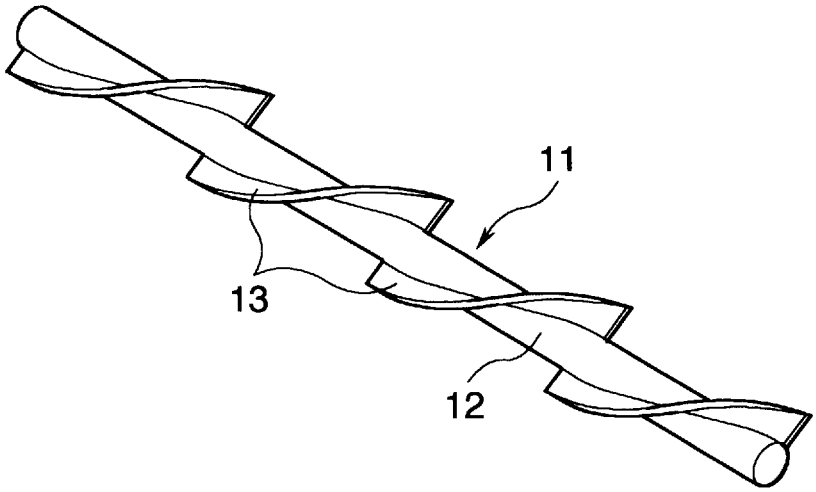
FIG. 4 is a typical perspective view showing a second example of a wiping member according to the present invention.

FIG. 4 is a typical perspective view showing a second example of the wiping member 11 according to the present invention. In this example, a plurality of spiral wiper portions 13 are secured on the peripheral surface of the cylindrical support 12. The spiral wiper portions 13 each are formed in a length shorter than the cylindrical support 12, and arranged in a spiral form with respective end portions axially overlapped so that adjacent wiper portions 13, 13 have an overlapping area in the axial direction. Other portions of the second example in FIG. 4 have substantially the same constitution as the previous example. Accordingly, with this example, in addition to the same action and effect as with the previous example, the higher reliability in the wiping operation is attained by reducing the contact area which can be brought into contact at the same time, owing to the shorter spiral pitch.

Figure 5:
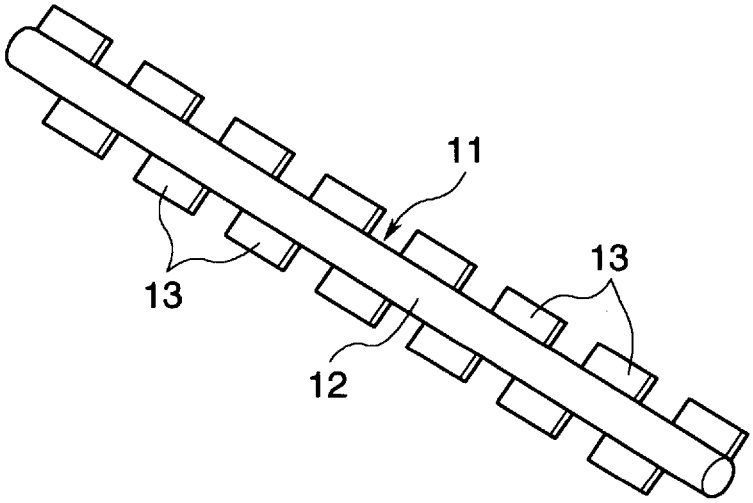
FIG. 5 is a typical perspective view showing a third example of a wiping member according to the present invention.

FIG. 5 is a typical perspective view showing a third example of the wiping member 11 according to the present invention. In this example, a plurality of wiper portions 13 having a significantly short axial length (e.g., a length of about 5 mm to 50 mm) each are arranged in a stagger form on the peripheral surface of the cylindrical support 12 to have a mutually overlapping area. Each wiper portion 13 is formed of a rubber elastic material like a flat plate having a predetermined thickness. Also, in the example as shown, the plurality of wiper portions 13 are divided into two sections 180 degrees apart circumferentially on the cylindrical support 12, but it will be appreciated that this arrangement of the wiper portions 13 may be made in a variety of different forms as far as the entire area of the array of discharge ports can be slidingly cleaned. The other portions of the third example in FIG. 5 are substantially the same as the previous examples. And with this example, the same action and effect as those of the previous examples can be also obtained.

It should be noted that the ink jet recording apparatus according to the present invention may be employed as an image output terminal of an information processing equipment such as a computer, and further in the forms of a copying machine in combination with a reader and a facsimile apparatus having the transmission and reception features.

As can be clear from the above description, according to the claim 1 of the invention, there is provided an ink jet recording apparatus which performs the recording by discharging the ink from recording means onto the recording sheet, comprising a wiping member for slidingly cleaning the discharge port face of recording means, such that the partial area of the wiping member can be brought into contact with part of the discharge port face at the same time, wherein the entire area of the array of discharge ports can be wiped uniformly by diminishing the deformation or distortion of the contact portion of the wiping member by reducing the contact face of the wiping member which can be brought into contact with the discharge port face at the same time, and moving successively the contact face between the wiping member and the discharge port face.

According to the claims 2 to 5, in addition to the constitution of claim 1, there is provided an ink jet recording apparatus wherein the wiping member is rotated in a direction perpendicular to the array of discharge ports, its contact area with the discharge port face being moved along with the rotation, wherein the wiping member has one or more spiral wiper portions, wherein the wiping member has a plurality of wiper portions arranged in a stagger form, or wherein a wiper cleaner disposed near the wiping member for absorbing the foreign matter adhering to the wiping member by making contact with the wiping member when the wiping member is further rotated, whereby it is possible to wipe the entire area of the array of discharge ports uniformly by reducing the contact face of the wiping member which can be brought into contact with the discharge port face at the same time to diminish the deformation or distortion of the contact portion of the wiping member more efficiently, as well as moving successively the contact face between the wiping member and the discharge face.

What is claimed is:

1. A wiping member for slidingly cleaning a discharge port face of recording means for recording, the discharge port face having an array of discharge ports disposed thereon, the recording means being provided in an ink jet recording apparatus which performs recording by discharging ink from the recording means onto a recording sheet, wherein said wiping member comprises:

a rotatable cylindrical support;

means for rotating said cylindrical support in a direction perpendicular to the array of discharge ports; and an elastic member disposed on said cylindrical support, said elastic member comprising a plurality of discontinuous spiral wiper portions each having a length shorter than the array of discharge ports, said spiral wiper portions being arranged so that adjacent wiper portions having overlapping portions that wipe a common area of the discharge port face, wherein a contact area of said elastic member with the discharge port face is moved along with a rotation of said cylindrical support.

2. A wiping member according to claim 1, wherein said wiper portions are arranged in a stagger form.

3. A wiping member according to claims 1 or 2, further comprising a wiper cleaner disposed substantially parallel to said cylindrical support and at a distance with respect to said wiping member so as to make contact with said elastic member when said wiping member is further rotated, thereby absorbing foreign matter adhering to said elastic member.

4. An ink jet recording apparatus which performs recording by discharging ink onto a recording sheet from recording means for recording having a discharge port face with an array of discharge ports disposed thereon, comprising a rotatable wiping member for slidingly cleaning the discharge port face of the recording means, wherein said wiping member is rotatable in a direction perpendicular to the array of discharge ports, said wiping member has a plurality of discontinuous spiral wiper portions each having a length shorter than the array of discharge ports, said spiral wiper portions being arranged so that adjacent wiper portions having overlapping portions that wipe a common area of the discharge port face, and a contact area of said wiping member with the discharge port face is moved along with a rotation of said wiping member.

5. An ink jet recording apparatus according to claim 4, wherein said wiper portions are arranged in a stagger form.

6. An ink jet recording apparatus according to claims 4 or 5, further comprising a wiper cleaner disposed substantially parallel to said cylindrical support and at a distance with respect to said wiping member so as to make contact with said wiping member when said wiping member is further rotated, thereby absorbing foreign matter adhering to said wiping member.

7. An ink jet recording apparatus according to claim 4, characterized in that said recording means is an ink jet recording means for ink let recording having electrothermal converters for generating heat energy for use in discharging the ink.

8. An ink jet recording apparatus according to claim 7, characterized in that said recording means discharges the ink through the discharge ports by using film boiling caused in the ink by the heat energy generated by said electrothermal converters.

* * * * *